US007425196B2

(12) United States Patent
Jorgensen et al.

(10) Patent No.: US 7,425,196 B2
(45) Date of Patent: Sep. 16, 2008

(54) BALLOON ENCAPSULATED DIRECT DRIVE

(75) Inventors: Martin Bondo Jorgensen, Vaerlose (DK); Karsten Videbaek, Roskilde (DK)

(73) Assignee: Sonion Roskilde A/S, Roskilde (DK)

( * ) Notice: Subject to any disclaimer, the term of this patent is extended or adjusted under 35 U.S.C. 154(b) by 583 days.

(21) Appl. No.: 10/741,444

(22) Filed: Dec. 22, 2003

(65) Prior Publication Data

US 2004/0215053 A1 Oct. 28, 2004

(51) Int. Cl.
*H04R 25/00* (2006.01)

(52) U.S. Cl. ..... 600/25

(58) Field of Classification Search ..... 600/25, 600/137; 381/23.1, 312, 322, 325, 328; 181/126, 181/129, 130–134, 135–137; 374/158
See application file for complete search history.

(56) References Cited

U.S. PATENT DOCUMENTS

| | | | | |
|---|---|---|---|---|
| 4,133,984 | A | 1/1979 | Akiyama | |
| 4,539,440 | A | 9/1985 | Sciarra | |
| 4,834,211 | A | 5/1989 | Bibby | |
| 5,333,622 | A | 8/1994 | Casali | |
| 5,338,287 | A | 8/1994 | Miller et al. | |
| 5,500,902 | A * | 3/1996 | Stockham et al. | 381/320 |
| 6,094,494 | A * | 7/2000 | Haroldson | 381/328 |
| 6,339,648 | B1 * | 1/2002 | McIntosh et al. | 381/328 |
| 6,438,244 | B1 * | 8/2002 | Juneau et al. | 381/322 |
| 6,901,288 | B2 * | 5/2005 | Janke et al. | 607/9 |
| 2001/0043708 | A1 * | 11/2001 | Brimhall | 381/328 |
| 2002/0114479 | A1 | 8/2002 | McIntoch et al. | |
| 2002/0136421 | A1 * | 9/2002 | Topholm | 381/314 |
| 2002/0196958 | A1 * | 12/2002 | Halteren et al. | 381/328 |

FOREIGN PATENT DOCUMENTS

| | | |
|---|---|---|
| EP | 0855847 | 7/1998 |
| WO | WO 02/067626 A2 | 8/2002 |

OTHER PUBLICATIONS

Search Report.

* cited by examiner

*Primary Examiner*—Charles A. Marmor, II
*Assistant Examiner*—Christine D Hopkins
(74) *Attorney, Agent, or Firm*—Harness, Dickey & Pierce, P.L.C.

(57) ABSTRACT

The present invention relates to a receiver module adapted to be positioned in an ear canal. The receiver module comprises a receiver having a receiver housing and expansible arrangement surrounding at least part of the receiver housing, the expansible arrangement having a first opening aligned with an output port of the receiver housing so as to allow for generated acoustic waves to propagate away from the receiver module and into the ear canal, the receiver module further comprising elastic encapsulation material partly encircling the expansible arrangement, the elastic encapsulation material being adapted to provide, in an expanded state of the expansible arrangement, a second opening aligned with the output port of the receiver housing so as to allow for the generated outgoing acoustic waves to propagate away from the receiver module and into the ear canal.

23 Claims, 2 Drawing Sheets

BALLOON ENCAPSULATED DIRECT DRIVE

FIELD OF THE INVENTION

The present invention relates to the field of hearing aids, more particularly to receiver modules for hearing aids, and more particularly to receiver modules intended for being positioned within the ear canal of a user. The invention in particular relates to expansible receiver modules encapsulated in a flexible membrane.

BACKGROUND OF THE INVENTION

Hearing aids with parts positioned deeply in an ear canal of a user, close to the user's eardrum, have a number of acoustical advantages compared to other types for instance with respect to suppression of feedback. Especially hearing aids with inflatable means provide a number of advantages also with respect to wearing comfort for the user.

U.S. Pat. No. 6,094,494 describes a device and method for fitting a sound transmission device to provide an easy and effective fit, reduce feedback, and improve user comfort comprises an ear-piece component having a face at one end with operative components and a stem adjacent the other end. The stem houses a speaker tube which protrudes from the component, and it has a retaining means for securing an inflatable, resilient fitting balloon thereon. The balloon has a sound transmission duct within it which can be coupled to the speaker tube so that when the balloon is secured to the stem, a continuous path is provided for the transmission of sound from the component to the user's ear canal external the balloon. This assembly (e.g., the component and attached balloon) is inserted into the ear canal when the balloon is in a deflated configuration. Air is then pumped into the balloon, e.g., through an air channel in the ear-piece component, to inflate the fitting balloon. The inflated fitting balloon engages the ear-piece component against the walls of the user's ear canal and prevents sound from travelling to the external ear and face of the component.

U.S. Pat. No. 4,133,984 describes a plug-type hearing device comprising a sound-leading portion being inserted into the auditory meatus, a first envelope attached around the sound-leading portion, a second envelope being positioned at the outside of the auditory meatus and being communicated with the first envelope through a pipe, and a holding means for holding an expanded state of the first envelope when the volume of the latter is increased, wherein the volume of the second envelope is decreased to increase the volume of the first envelope by the pressure of a fluid contained inside, and the expanded first envelope is closely contacted with the wall surface of the auditory meatus.

However, insertion of an object deeply into the ear canal, close to the eardrum, implies a high risk for occlusion of the sound transmission duct or sound port of the hearing aid due to cerumen being pressed into the sound duct opening or port during insertion. In case the duct or port is occluded this will result in malfunction of the hearing aid such as reduced efficiency and possibly also in a decreased lifetime of the hearing aid if delicate parts of the hearing aid are damaged due to cerumen. In addition, the described hearing aids are difficult to clean properly.

SUMMARY OF THE INVENTION

It may be seen as an object of the present invention to provide a hearing aid device adapted for being positioned within the ear canal of a user. The device must be adapted for being positioned in a bony part of the ear canal. The device must have a large degree of acoustic and vibration feedback suppression and thus being adapted for high gain hearing aids. In addition, it must be comfortable to wear, easy to operate, and easy to maintain.

According to a first aspect of the present invention the object is complied with by providing a receiver module adapted to be positioned in an ear canal, the receiver module comprising a receiver having a receiver housing, the receiver being adapted to receive a time dependent electrical signal, the receiver further being adapted to generate outgoing acoustic waves via an output port in the receiver housing in response to the received time dependent electrical signal, expansible means surrounding at least part of the receiver housing, the expansible means having a first opening aligned with the output port of the receiver housing so as to allow for the generated and outgoing acoustic waves to propagate away from the receiver module and into the ear canal, and encapsulation means partly encircling the expansible means, the encapsulation means being adapted to provide, in an expanded state of the expansible means, a second opening aligned with the output port of the receiver housing so as to allow for the generated outgoing acoustic waves to propagate away from the receiver module and into the ear canal.

By the phrase "expanded state" is meant a degree of expansion of the exansible means where the receiver module is properly positioned in the ear canal of a person having an ear canal of average dimensions, especially an ear canal with an average cross sectional area. Proper position includes that the receiver module is mounted for normal use and fits close to the ear canal but still being comfortable to wear for the user.

The receiver module may further comprise a tube section having first and second end parts, the expansible means protruding from the first end part of the tube section, the encapsulation means forming, in combination with at least the tube section, a waterproof encapsulation of the receiver in a relaxed state of the expansible means.

By the phrase "relaxed state" is meant a not expanded state of the expansible means. The relaxed state is assumed a normal state of the expansible means when the receiver module is not positioned in the ear canal, such as by storage etc. The relaxed state is also assumed to be the expansible state used for easy and comfortable insertion into position in the ear canal.

The encapsulation means may be attached to the first end part of the tube section, and form a waterproof passage with the tube section. The encapsulation means may be attached to the second end part of the tube section, and form a waterproof passage with the tube section. The encapsulation means may be attached to the expansible means, and form a waterproof passage with the expansible means.

The encapsulation means may comprise an elastic material. The elastic material may be selected from the group consisting of: silicone, latex, artificial rubber, and TPE (Thermo-Plastic Elastomer).

The second opening may comprise a perforation. The perforation may comprise a substantially circular hole. The second opening may have, in an expanded state of the expansible means, an opening area being more than or equal to 10% of an opening area of the output port of the receiver housing. The opening area may be equal to or larger than the opening area of the output port of the receiver housing.

The encapsulation means may further comprise attachment means. The attachment means may comprise a flexible torus. The flexible torus may be an O-ring forming part of the encapsulation means.

The receiver module may further comprise a vent canal adapted to equalise pressure between, at one side, a part of the ear canal between the receiver module and an ear drum, and at another side, atmospheric pressure. The vent canal may form part of the encapsulation means. A flexible tube may form the vent canal.

The receiver module may further comprise pump means for providing a medium to the expansible means so as to expand the expansible means. The pump means may be adapted to be mechanically activated. The pump means may comprise a threaded spindle. The pump means may comprise a string adapted to operate the pump means. The pump means may comprise a miniature pump. The miniature pump means may be adapted to be electrically activated. The electrically activated miniature pump may be adapted to be controlled in accordance with a detected acoustical signal. The electrically activated miniature pump may be adapted to be controlled in accordance with a detected air pressure representing the detected acoustical signal. The electrically activated miniature pump may be adapted to be controlled in accordance with detected frequencies constituting the detected acoustical signal.

In a second aspect of the present invention the object is complied with by providing a hearing aid comprising a receiver module according to the first aspect. The hearing aid may be selected from the group consisting of BTE, ITE, ITC and CIC. The hearing aid may further comprise a microphone adapted to convert the detected acoustical signal to a miniature pump control signal. The miniature pump control signal may be adapted to control pressure of the medium provided by the miniature pump to the expansible means.

BRIEF DESCRIPTION OF DRAWINGS

A more detailed description of the invention and preferred embodiments is given below with reference to the accompanying figures, in which.

Figure 1:
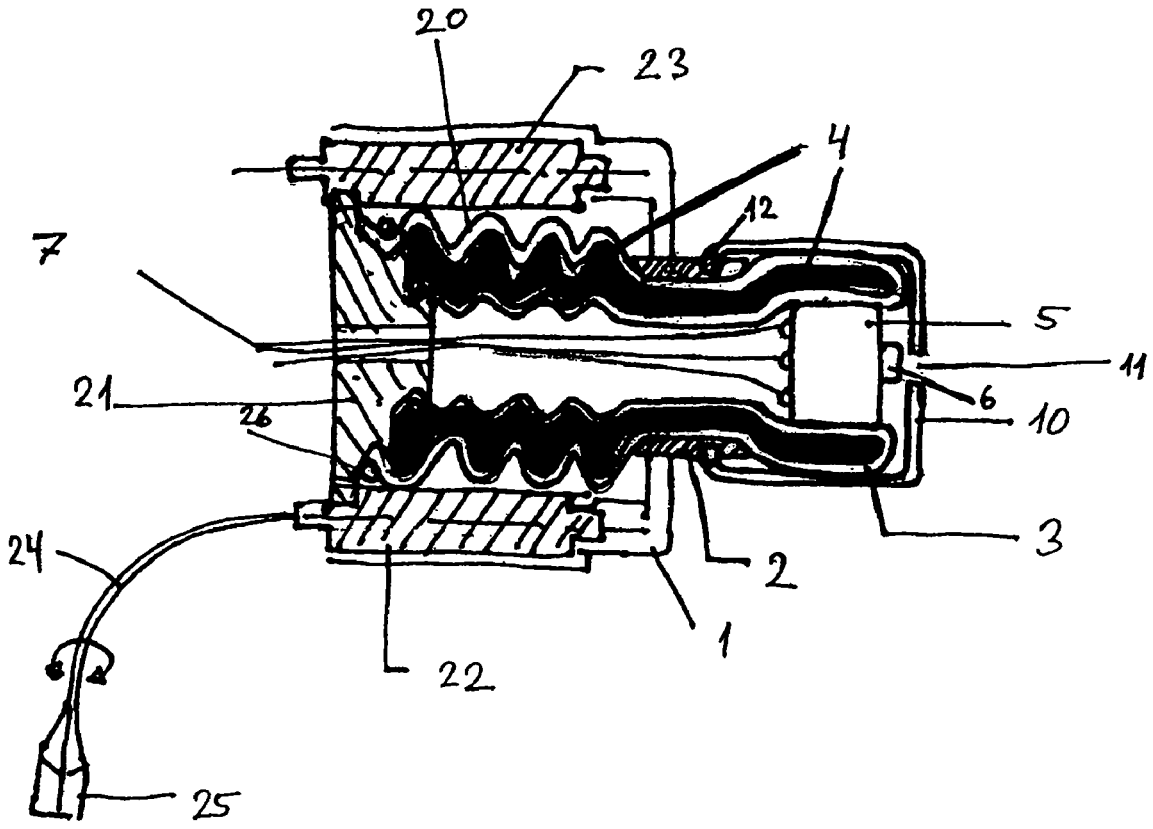
FIG. 1 shows a cross section of a preferred embodiment.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

A preferred embodiment is seen in FIG. 1. An expansible part of the receiver module includes the receiver 5 with a receiver port 6. This part is adapted for mounting in the ear canal close to the eardrum. The receiver module has expansible means formed by an elastic chamber 3 with a membrane made of an elastomeric material for example silicone or rubber. The chamber is filled with an expansion medium 4 such as gas, a liquid, a gel or foam. Preferably the chamber membrane is made of a material that allows penetration of a thin needle through the membrane so as to allow refilling of expansion medium 4 without destroying the membrane's tightness.

The expansible means is adapted to be expanded by inflation so as to form a substantially airtight sealing between the receiver part and the inner part of the ear canal where the acoustic port 6 of the receiver 5 radiates acoustic signals.

Alternatively, the expansible means may comprise a memory alloy or memory metal such as nickel-titanium or copper-zinc-aluminium or iron-manganese-silicon etc. Memory metal based expansible means may be adapted to change shape between two predetermined shapes, such as a relaxed and an expanded state, in response to a temperature of the receiver module or a voltage or current applied to the expansible means. The application of nickel-titanium alloys or Nitinol is particularly advantageous due to its biocompatible nature.

Preferably the receiver part is positioned close to the ear canal in the bony part of the ear canal. In an expanded state the receiver module fits substantially air tight to the ear canal thus forming a very small volume enclosed between an end part of the receiver module with the acoustic port 6, the inner part of the ear canal and the ear drum.

The receiver module further comprises a tube section. The first end part of the tube section 2 is adapted to follow the curvature of the user's ear canal. This part of the tube section 2 however must be firm enough not to expand as much as the expansible means. The expansible means protrudes from the first end part of the tube and it is encapsulated by an encapsulation means 10. The second end part of the tube section 1 has a larger diameter than the first end part. The second end part of the tube section 1 comprises pump means and reservoir connected to the expansible means. The pump means is adapted for expanding and compressing the expansible means by either pumping the medium from the reservoir to the expansible part of the expansible means. The embodiment shown in FIG. 1 has manually controllable pump means. A string 24 with a knob 25 is used to drive a threaded spindle 22 that activates a bellow formed part of the expansion chamber 20 of the expansible means 3.

The second end part of the tube section also forms the interface to an outer part of the hearing aid comprising a microphone, signal processing means and a battery. The second end part therefore may comprise a socket for connecting electrical wires 7 from the receiver 5 so as to connect the receiver 5 to an amplifier delivering a signal which the receiver 5 is intended to transform to an acoustical signal. The signal to be applied to the receiver 5 may be either in a digital or an analog form.

An encapsulation means shown in FIG. 1 is formed by a balloon-like membrane or sheath 10 of an elastic and flexible material. The sheath 10 encircles the receiver part so as to shield the receiver 5. The sheath 10 is intended to follow the changing circumference made available by the expansible means. This may be obtained by a sheath 10 made of materials such as latex, silicone or a Thermo-Plastic Elastomer (TPE). The sheath 10 preferably has a thickness of 0.1-0.2 μm. Since the sheath 10 is in connection with the skin of the ear canal, and even preferably the highly sensitive bony part of the ear canal, the sheath material is important with respect to the degree of wearing comfort that can be obtained. Silicone is known to have excellent properties with respect to contact with the human skin.

One important feature of the sheath is to increase the wearing comfort for the user. When inserting the receiver module into the ear canal in a relaxed (not expanded) state of the expansible means it is important that the sheath has a smooth surface providing a minimum of friction with the user's ear canal thus causing a minimum of pain or discomfort during insertion. The increased comfort level allows a position of the receiver module in the inner, bony part of the ear canal thus very close to the ear drum to be activated by the acoustic output from the receiver. This again has a number of acoustic advantages.

Another important feature of the sheath is that it covers or protects against cerumen being pushed into the acoustic port of the receiver. Such cerumen may partly block the acoustic port and thereby severely reduce the acoustic output. Thus the sheath has the effect that it protects against poor performance of the hearing aid caused by cerumen. According to the present invention the sheath provides a waterproof encapsulation of the receiver when the expansible means is in a relaxed state such at it intended to be for insertion.

When properly inserted and expanded in the ear canal the sheath 10 provides an opening 11 aligned with the acoustic port 6 of the receiver 5 so as to allow acoustic waves to freely propagate from the receiver module and into the ear canal. A simple way to implement this is to manufacture the sheath 10 with a small perforation, such as a circular hole. The size of the perforation must be adjusted to the elastic properties of the sheath material and the dimensions the expansible means so that the opening 11 is waterproof in a relaxed state of the expansible means, e.g. opening dimension should be smaller than 0.1-0.2 mm. In an expanded state of the expansible means the elastic properties of the sheath 10 must cause the hole to increase in size so as to form an opening 11 aligned with the acoustic port 6 of the receiver 5 so as to allow sound waves to propagate away from the receiver with as small acoustic attenuation as possible, preferably without attenuation.

An aperture formed by one or more slots may also provide an opening. An alternative to the slot shape is a diaphragm version where the opening is formed by at least two parts of the sheath material overlapping in a relaxed state of the expansible means. In an expanded state the overlapping parts are designed so as to provide an opening of substantially the same size as the acoustic port of the receiver and the opening being aligned with this port.

Alternatively the opening may be formed as a mouth or an orifice. Still these embodiments can be formed so as to ensure a waterproof encapsulation in a relaxed state of the expansible means while providing an acoustic opening in an expanded state of the expansible means. A simple mouth type opening may be formed by a flexible O-ring. A flexible torus with other shapes may also be used. Compared to the simple and low cost solutions with the opening being provided by a perforation solutions with a mouth or orifice may be better protected against damage of the opening.

An additional feature of the sheath is that it is easy for the user to clean the receiver module, such as removing cerumen. Since the sheath according to the present invention provides a waterproof protection of the receiver in a relaxed state of the expansible means, it is possible to wash or rinse the receiver module with water for instance under a tap.

Yet another feature of the sheath is that it protects the user against discomfort in case the receiver is detached from the receiver module by accident. This could otherwise hurt the user and in serious cases even damage the user's eardrum. In such a case the presence of the sheath will keep the receiver from freely falling into the ear canal, provided that the opening in the sheath is, in an expanded state of the expansible means, wide enough to minimise the acoustic attenuation of the sound propagating from the receiver port but still being smaller than the receiver.

Figure 2:
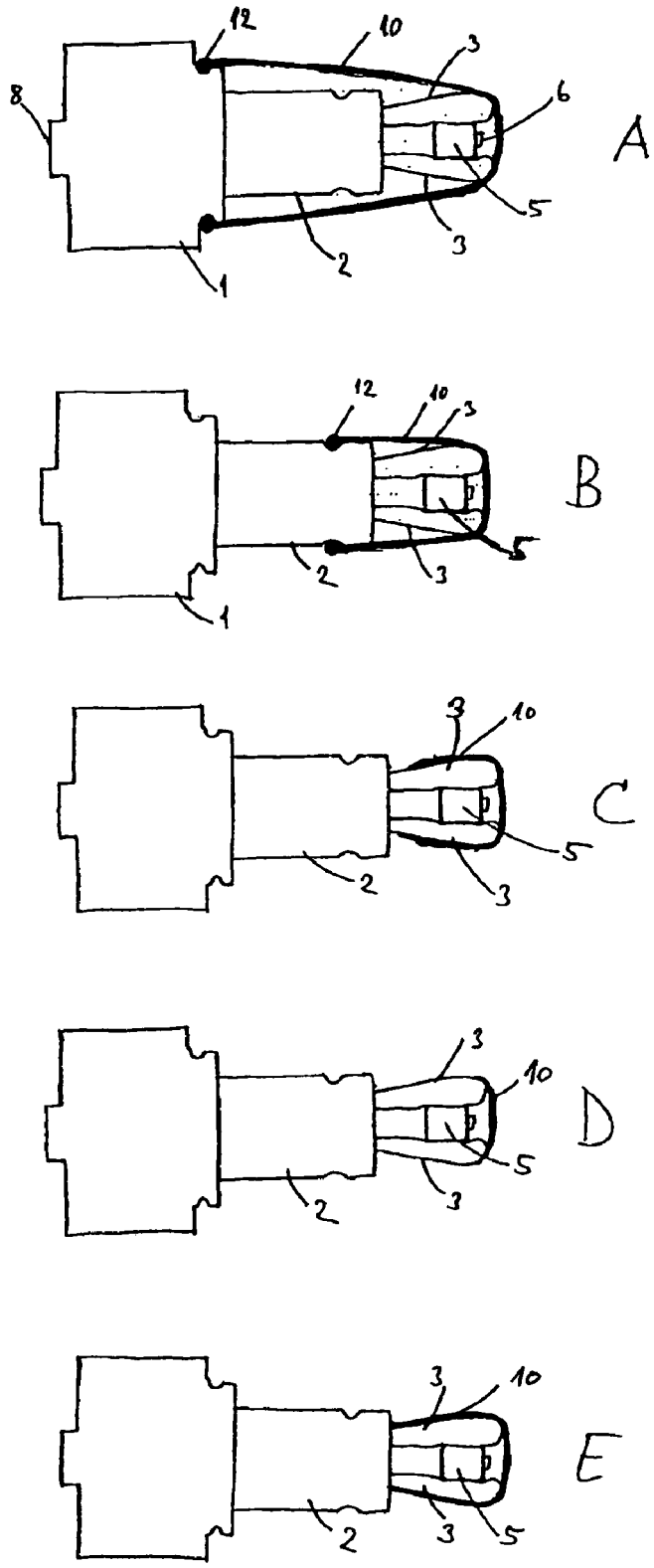
FIG. 2 shows 5 different embodiments of the encapsulation means.

According to the present invention the encapsulation means can be attached in various ways and by various means. FIG. 2 shows different positions and attachments of encapsulation means 10 all formed by an elastic material and sketched as solid black. The various embodiments sketched in FIG. 2 are denoted A, B, C, D, and E. The sketches shown in FIG. 2 all show the expansible means in a relaxed state. Therefore, the opening 11 of the encapsulation means 10 is not shown since in a relaxed state of the expansible means the opening 11 is small enough to exclude liquid from passing through it. The outward end of the housing 1 formed by the second end of the tube section 1 is supplied with a socket 8 for electrical connection to other parts of the hearing aid not shown.

Embodiment A of FIG. 2 shows an encapsulation means formed as a flexible sheath 10 encapsulating the receiver 5, the part of the expansible means 3 protruding from the first end part of the tube section 2, the first end part of the tube 2. The sheath 10 also partly covers the second end part of the tube section 1. The sheath 10 is attached with a flexible O-ring 12 in a recess of the second end part of the tube section 1. In this way the sheath 10 is kept in place by the elastic force of the sheath itself 10 and the elastic force of the flexible O-ring 12. So as to provide an elastic force the O-ring 12 should, in a relaxed state, have a diameter being smaller than the diameter of that part of the second end part of the tube section 1 to which the sheath 10 is fastened. With this type of fastening the user may easily be able to replace the sheath 10 for example in case it is damaged. However, the sheath 10 may also be fastened by means of adhesives.

Embodiment B shows a sheath 10 that may be attached with the same methods as described for embodiment A, i.e. a flexible O-ring 12. Embodiment B, though, is attached to the first end part of the tube section 2, the flexible part of the tube section. Preferably the connection between the first end part of the tube section 2 and the second part of the tube section 1 provides a waterproof passage so as to form a waterproof encapsulation of the receiver 5.

Embodiment C shows a sheath 10 attached to the part of the expansible means 3 protruding from the first end part of the tube section 2 so as to partly encapsulate this part of the expansible means 3. The sheath 10 may be attached with adhesives such as a two-part glue or by thermoplastic welding if a TPE material is used. However, it may also be self attached merely by its elastic properties. So as to form a waterproof encapsulation of the receiver 5 it is, in addition to that described for embodiment B, necessary that a passage between the expansible means and the first end part of the tube section 2 is waterproof.

Embodiment D shows, as for embodiment C, encapsulation means 10 formed as a small membrane positioned on a front part of the expansible means 3. Requirements for a waterproof encapsulation of the receiver 5 and attachment methods are the same as described for embodiment C.

Embodiment E shows a sheath 10 encapsulation comparable with embodiment C. However, in E the sheath 10 encapsulates the entire part of the expansible means 3 protruding from the first end part of the tube section 2. The sheath forms an integral part of the encapsulation means.

In case a liquid is used especially the embodiments A, B and E will help to protect the user against liquid penetrating through a hole in the expansible chamber and into the ear canal. The hole may be generated accidentally due to a damage of the expansible chamber. Hereby, possibly dangerous or poisonous liquid may otherwise get in contact with the skin of the ear canal and the eardrum. Even though the amount of liquid in the expansible chamber may be in the order of only 0.2-0.3 ml it may in some way injure the user or at least create discomfort.

Preferably the receiver module comprises a vent canal for equalising a static pressure between at the inside a volume of the ear canal between the receiver module and the eardrum, and at the outside an atmospheric pressure. If this pressure is not equalised occlusion effects may occur thus causing discomfort and possibly loss of hearing sensitivity since the eardrum will be displaced from its natural equilibrium state.

The vent canal may form part of the expansible means and the tube section so as to establish an unbroken vent canal from the second end part of the tube section to a point adjacent to the opening of the inflatable means. The opening of the vent canal to the inside volume may be formed so that it is adjacent to the acoustic port of the receiver or it may be integral with the acoustic port. The vent canal opening may also be positioned in a cavity formed by the receiver, the expansible means and the encapsulation means. In the latter case the static pressure may be equalised through a separate opening in the encapsulation means especially suited for this purpose or it may be equalised through the opening intended for allowing acoustic waves to propagate from the receiver port. The vent canal may be a tube that has a flexible structure allowing the tube to follow the curvature of the ear canal. At the same time the tube must be solid enough so that it is not squeezed flat by the pressure provided by the expansible means in an expanded state. A vent canal tube may be manufactured in a material such as plastic.

A vent canal can also be made integral with the encapsulation means. The canal may be manufactured separately and then attached to the encapsulation means for instance by adhesives such as two-part glue. The vent canal can either be positioned on the inside or the outside of the encapsulation means. If positioned on the inside of the encapsulation means separate openings in the encapsulation means may be required so as to establish the vent. In case the encapsulation means is formed as a sheath of silicone, latex or some type of synthetic rubber material, a vent canal may be formed as a fold of the sheath in the length direction.

A vent canal may also be formed via the receiver by connecting a back volume of the receiver to an opening of a tube with the tube having its other end connected to the outside. In this way the internal vent of the receiver connecting a front and a back side of the receiver diaphragm is used to connect the occluded volume of the inner part of the ear canal with the outside air.

The pump means for expanding and compressing the expansible means may have a large variety of implementations. The embodiment shown in FIG. 1 has a simple manually controlled pump means. This pump means is positioned in the second end of the tube section 1 that forms a housing 1. By turning a knob 25 at the end of a string 24 connected to the pump drive it is possible for the user to operate the pump and thereby control the expansible state of the expansible means. The string 24 must be of a material that is substantially rigid for torsional movements, such as metal or nylon types. By turning the knob 25 one way the expansible means is expanded and by turning the knob 25 the opposite way the expansible means is relaxed. The user operated string 24 is connected to drive a threaded spindle 22 which also comprises two or more free running spindles 23. The threaded spindle 22 drives a piston formed end part 21 of the bellow 20. A part of the piston forms a gear wheel 26 interacting with the threaded spindle 22. The two or more free running spindles 23 are positioned in the outer periphery of the piston 21 so as to stabilise the motion of the piston 21. Since the bellow 20 forms part of the expansion chamber of the expansible means a compression state of the bellow 20 thus determines the expansion state of the expansible means.

When the piston 21 in FIG. 1 is driven towards the first end section of the tube 2 by turning the knob 25 on the user operated string 24 the expansion medium 4 will be pressed towards the same end, and thus the expansible means will expand and thereby increase a diameter of the expansible part of the expansible means. When expanded during normal use the expansible part will increase to a diameter corresponding to a tight fit to a normal size ear canal. Due to its elastic properties the encapsulation means 10 will expand along with the expansible means. The opening 11 in the encapsulation means 10 is adapted to expand gradually together with the expansion process. The opening 11 is aligned with the acoustic port 6 of the receiver 5 thus allowing acoustic waves to freely propagate from the receiver module into the ear canal in an expanded state. The size of the opening 11 must be adapted so as to ensure that it is essentially closed in a relaxed or compressed state of the expansible means so as form a waterproof shield for the receiver. In an expanded state the opening 11 must form have a size corresponding to the size of the port 6 of the receiver 5 or larger than that. However, preferably the opening 11 should still be so small that it is not possible for the receiver 5 to pass the opening and thereby fall into the ear canal in case it becomes loose accident.

Turning the knob 25 the opposite way results in an opposite movement of the piston 21 and this will result in an expansion of the bellow part 20 of the expansible means. Hereby, the expansion medium 4 will be pressed from the expansible part of the expansible means towards the bellow 20 and the expansible means will thus go towards a more compressed or relaxed state. In a compressed or relaxed state the diameter of the expansible means is smaller than the diameter of a normal size ear canal so as to allow the receiver module to be inserted and positioned freely before expansion.

The pump means described above may comprise means for quickly releasing the expansible means. The string may activate the driving spindle via two conic gear wheels—one connected with the string and one connected with the driving spindle. The gear wheel connected with the string is forced to interact with the gear wheel connected with the driving spindle by the force of a spring. When pulling the string the two gear wheels are drawn away from interaction and thus releases the driving spindle that will tend to move outwards forced by the expansion medium if the expansible means is in an expansible state. Thereby a quick relaxation of the expansible means can be obtained without the need for turning the user operated string.

The pump means may be controlled by an electrically driven miniature pump. The pump should then serve the same purpose as described above for the bellow solution namely to move the expansion medium from one part of the expansion chamber to another. Hereby it is possible to control the expansion and compression from the part of the hearing aid being external to the ear canal. This can be done either by a switch positioned on the part of the hearing aid being external to the ear canal or by a remote control, such as a wireless control box which can be kept in the user's pocket. In addition, such a remote control box can be used to control a number of other parameters of the function of the hearing aid as well, such as gain, directivity of the microphone system, switching to and from induction loop systems, and parameters concerning advanced signal processing for improved speech intelligibility depending of the environment etc.

Using an electrically driven miniature pump for controlling the expanded state of the expansible means provides a number of possibilities for controlling the expanded state automatically. By using electrical signal processing means such as a microprocessor or digital signal processor (DSP), comprised within the hearing aid, the miniature pump can be controlled so as to adjust expansion of the expansible means in relation to internal signal processing parameters of the electrical signal processing means. In a particularly preferred embodiment of the invention, the expansion of the expansible means is adjusted in accordance with one or several time-varying gain parameters of the electrical signal processing means that controls an acoustical gain of the hearing instrument. Since most hearing instruments use dynamic range compression, such as multi-channel wide dynamic range compression, to adaptively adjust the acoustical gain of the hearing instrument to an incoming sound pressure level, the acoustical gain of the instrument varies over time.

However, by automatically adjusting the expansion of the expansible means according to the requirements dictated by an instantaneous acoustical gain selected by the electrical processing means, the user's comfort level is optimised even without the need for the user to constantly perform a manual adjustment.

The expansion of the expansible means may be adjusted in accordance with a time-varying gain parameter that represent the acoustical gain of the hearing instrument in a predetermined frequency range such as 1-5 kHz or 2-4 kHz or around 3 kHz to control the expansible means based on a frequency range that often lead to feedback problems.

In yet another embodiment of the invention that also supports adaptive setting of the expansion of the expansible means, the expansion of the expansible means is determined and fixed during a fitting session of the hearing instrument through a fitting software interface. Since maximum values of the time-varying gain parameters associated with the electrical signal processing means are determined at this point in time, the expansion required to avoid feedback problems may be determined in accordance with the maximum acoustical gain set in the hearing instrument. Accordingly, individuals with relatively small hearing losses, and therefore a low gain requirement, may be exposed to less expansion of the expansible means of the receiver module and thereby more comfort compared to individuals with moderate and severe hearing losses.

The described embodiments have further advantages with respect to its acoustical function, e.g. with respect to suppress feedback which normally determines the maximum possible gain of a hearing aid. Acoustical feedback is effectively suppressed since it is possible to position the receiver part in the bony part of the ear canal thus very close to the eardrum. The part of the hearing aid comprising the microphone is positioned a large distance therefrom. In addition, a significant acoustical transmission loss is provided by the substantially airtight liquid inflated sealing between the receiver part and the ear canal. If a vent canal is included it is possible to design the canal so as to provide a substantial acoustic attenuation in the audible frequency range. Thereby acoustic feedback though the vent canal can be reduced to an insignificant level.

Structure-borne feedback or vibration feedback between receiver and microphone is also effectively suppressed since the receiver is resiliently mounted in the receiver part via the liquid chamber. Therefore, there are two possible structure-borne transmission paths between receiver and microphone: 1) via the expansible medium chamber and the human tissue, and 2) via the expansible medium chamber, the flexible tube and the electrical connectors. None of these paths have structures that can possibly transmit vibrations without a significant transmission loss.

Consequently, the above-described embodiments are well suited for hearing aids adapted to provide a high acoustical gain and they are therefore also applicable for severely hearing impaired persons.

The shown embodiment is especially suited for IC (In Canal) or CIC (Completely In Canal) type hearing aids. However, an embodiment suited for BTE (Behind The Ear) type hearing aids can easily be derived from the shown embodiment. In BTE type hearing aids a microphone and a receiver is comprised within an outer part of the hearing aid. Therefore, the interface between the inner and outer part of the hearing aid may instead of an electrical connection be connected by a tube for transmitting the acoustic output of the receiver to the inner part, through the tube section and into the inner part of the "receiver module" (which in a BTE case does not comprise a receiver) and into the ear canal via an output port positioned just as described above in case of a receiver positioned in the receiver module.

The invention claimed is:

1. A receiver module adapted to be positioned in an ear canal, the receiver module comprising a receiver having a receiver housing, the receiver being adapted to receive a time dependent electrical signal, the receiver further being adapted to generate outgoing acoustic waves via an output port in the receiver housing in response to the received time dependent electrical signal, an expansible structure surrounding at least part of the receiver housing, the expansible structure having a first opening aligned with the output port of the receiver housing so as to allow for the generated and outgoing acoustic waves to propagate away from the receiver module and into the ear canal, and elastic encapsulation material partly encircling the expansible structure, the elastic encapsulation material being adapted to provide, by expansion of the expansible structure, an expanded second opening aligned with the output port of the receiver housing so as to allow for the generated outgoing acoustic waves to propagate away from the receiver module and into the ear canal.

2. A receiver module according to claim 1, further comprising a tube section having first and second end parts, the expansible structure protruding from the first end part of the tube section, the elastic encapsulation material forming, in combination with at least the tube section, a waterproof encapsulation of the receiver in a relaxed state of the expansible structure.

3. A receiver module according to claim 2, wherein the elastic encapsulation material is attached to the first end part of the tube section, and forms a waterproof passage with the tube section.

4. A receiver module according to claim 2, wherein the elastic encapsulation material is attached to the second end part of the tube section, and forms a waterproof passage with the tube section.

5. A receiver module according to claim 1, wherein the elastic encapsulation material is attached to the expansible structure, and forms a waterproof passage with the expansible structure.

6. A receiver module according to claim 1, wherein the elastic encapsulation material comprises an elastic material.

7. A receiver module according to claim 6, wherein the elastic material is selected from the group consisting of: silicone, latex, artificial rubber, and TPE.

8. A receiver module according to claim 1, wherein the second opening comprises a perforation.

9. A receiver module according to claim 8, wherein the perforation comprises a substantially circular hole.

10. A receiver module according to claim 1, wherein the second opening has, in an expanded state of the expansible structure, an opening area being more than or equal to 10% of an opening area of the output port of the receiver housing.

11. A receiver module according to claim 10, wherein the opening area is equal to or larger than the opening area of the output port of the receiver housing.

12. A receiver module according to claim 1, the elastic encapsulation material further comprising an attachment member.

13. A receiver module according to claim 12, wherein the attachment member comprises a flexible torus.

14. A receiver module according to claim 13, wherein the flexible torus is an O-ring forming part of the elastic encapsulation material.

15. A receiver module according to claim 1, further comprising a pump for providing a medium to the expansible arrangement so as to expand the expansible structure.

16. A receiver module according to claim 15, wherein the pump comprises a miniature pump adapted to be electrically activated.

17. A receiver module according to claim 16, wherein the electrically activated miniature pump is controllable in accordance with internal signal processing parameters of an electrical signal processor of a hearing prosthesis to control expansion of the expansible structure.

18. A receiver module according to claim 17, wherein the internal signal processing parameters of the electrical signal processor represent gain values of the hearing prosthesis.

19. A hearing aid comprising a receiver module according to claim 1.

20. A hearing aid according to claim 19, further comprising a miniature pump and a microphone adapted to convert detected acoustical signal to a miniature pump control signal, wherein the miniature pump control signal is adapted to control pressure of medium provided by the miniature pump to the expansible structure.

21. A receiver module according to claim 1, wherein the second opening is essentially closed in a relaxed state of the expansible structure.

22. A receiver module according to claim 1, wherein the second opening has an opening dimension smaller than 0.2 mm in a relaxed state of the expansible structure.

23. A receiver module according to claim 1, wherein the second opening is waterproof in a relaxed state of the expansible structure.

* * * * *

UNITED STATES PATENT AND TRADEMARK OFFICE

CERTIFICATE OF CORRECTION

PATENT NO. : 7,425,196 B2
APPLICATION NO. : 10/741444
DATED : September 16, 2008
INVENTOR(S) : Martin Bondo Jorgensen et al.

It is certified that error appears in the above-identified patent and that said Letters Patent is hereby corrected as shown below:

On the title page insert the following:

--Related U.S. Application Data

(60) Provisional Application No. 60/435,268, filed on December 23, 2002.--

Signed and Sealed this

Seventeenth Day of February, 2009

JOHN DOLL
*Acting Director of the United States Patent and Trademark Office*